US008795109B2

(12) United States Patent
Román

(10) Patent No.: US 8,795,109 B2
(45) Date of Patent: Aug. 5, 2014

(54) ARROW CONSTRUCTION SYSTEM HAVING TIP CANISTER ELECTRONICS

(71) Applicant: Kendyl A. Román, Sunnyvale, CA (US)

(72) Inventor: Kendyl A. Román, Sunnyvale, CA (US)

(73) Assignee: Evrio, Inc., Santa Clara, CA (US)

( * ) Notice: Subject to any disclaimer, the term of this patent is extended or adjusted under 35 U.S.C. 154(b) by 0 days.

(21) Appl. No.: 13/647,172

(22) Filed: Oct. 8, 2012

(65) Prior Publication Data

US 2014/0100066 A1 Apr. 10, 2014

(51) Int. Cl.
*F42B 6/04* (2006.01)

(52) U.S. Cl.
USPC ..... 473/578; 473/570; 473/582

(58) Field of Classification Search
USPC ..... 473/570, 578, 582, 583, 585, 586
See application file for complete search history.

(56) References Cited

U.S. PATENT DOCUMENTS

| | | | | |
|---|---|---|---|---|
| 4,675,683 | A * | 6/1987 | Robinson et al. | 342/386 |
| 4,885,800 | A * | 12/1989 | Ragle | 455/98 |
| 5,141,229 | A | 8/1992 | Roundy | |
| 6,123,631 | A | 9/2000 | Ginder | |
| 6,364,499 | B1 | 4/2002 | Jones | |
| 6,390,642 | B1 | 5/2002 | Simonton | |
| 6,736,742 | B2 | 5/2004 | Price | |
| 7,021,784 | B2 | 4/2006 | DiCarlo | |
| 7,211,011 | B1 | 5/2007 | Sutherland | |
| 7,316,625 | B2 | 1/2008 | Takahashi | |
| 7,837,580 | B2 | 11/2010 | Huang | |
| 7,862,457 | B1 | 1/2011 | Urcheck | |
| 7,927,240 | B2 | 4/2011 | Lynch | |
| 7,931,550 | B2 | 4/2011 | Lynch | |
| 8,088,028 | B2 * | 1/2012 | Jones | 473/578 |
| 8,192,309 | B1 * | 6/2012 | Roberts | 473/578 |
| 8,251,845 | B2 * | 8/2012 | Bay | 473/583 |
| 2009/0098960 | A1 | 4/2009 | Brywig | |

* cited by examiner

*Primary Examiner* — John Ricci

(57) ABSTRACT

An arrow construction system comprising a tip canister configured to receive an arrow tip and to attach to an arrow shaft. The tip canister contains a power source and sensitive electronics. The power circuit may be a battery, a primary storage capacitor, a coil and a rectifier, and/or a solar cell. The tip canister may be electrically connected to the nock via the shaft electrical conduction system. The electrical conductors may be integrated into the shaft. The wires may form a cable with standard connectors. The nock may contain a light. Alternatively, the fletching may comprise light emitting film or fibers. The circuits may include a flash circuit, an audio circuit, a radio beacon, a wireless transmitter, environmental sensors, a camera, a switch, and/or a GPS device. The switch may be activated by a current detected in a coil or by an accelerometer.

23 Claims, 13 Drawing Sheets

ARROW CONSTRUCTION SYSTEM HAVING TIP CANISTER ELECTRONICS

BACKGROUND

1. Field of the Invention

The present invention relates to arrow construction, in particular the invention related to improved system for arrow construction having a tip canister and other electronic circuitry.

2. Description of Prior Art

When firing arrows, whether at an archery range or hunting, it is often difficult to track the movement or ultimate destination of an arrow. This often leads to the loss of arrows that otherwise would have been recovered. There have been many attempts to find ways to enable the archer to find his shot arrows, including adding lights to the tail end of the arrow. However, these lights are simple in design and must be manually switched on and off. This causes the battery to be continuously drained, shortening the lifespan of the light. Also, the battery is relatively heavy and located in the tail of the arrow, which affects the flight of the arrow. Further, on impact the battery or its connections often break.

SUMMARY OF THE INVENTION

Accordingly, it is an objective of this invention to provide an arrow construction system comprising a tip canister configured to receive an arrow tip and to attach to an arrow shaft. The tip canister contains a power source and sensitive electronics. The tip canister moves the weight associated with the power circuit and the electronics to the front of the arrow improving both arrow flight and reliability. The power circuit may be a battery, a storage capacitor, a coil and a rectifier, and/or a solar cell. The tip canister may be electrically connected to the nock via the shaft. The electrical connections or wires may pass through the hollow shaft or may be integrated into the shaft itself for more reliability, ease of assembly, and lower cost. The wires may form a cable with standard connectors. The nock may contain a light, such as an LED. Alternatively, the fletching may comprise light emitting film or fibers. Further, fletching may comprise solar electric film. The circuits may include a flash circuit, an audio circuit, a radio beacon, a wireless transmitter, a wind tracking apparatus, other sensors, a switch and/or a GPS device. The switch may be activated by a current detected in a coil or by an accelerometer. Current may be generated in a coil by passing the arrow through a magnetic field.

Another purpose is to allow archers to find their arrows using a flashing light source from the nock of the arrow.

Objects and Advantages

Accordingly, beside the objects and advantages described above, some additional objects and advantages of the present invention are:

1. To provide an arrow construction system comprising a tip canister.
2. To provide an arrow tip canister configured to receive an arrow tip.
3. To provide an arrow tip canister configured to attach to an arrow shaft.
4. To provide an arrow tip canister comprising a power circuit.
5. To provide an arrow tip canister comprising a battery.
6. To provide an improved method of carrying a battery in an arrow system.

7. To provide an arrow tip canister comprising a storage capacitor.
8. To provide an arrow tip canister comprising a rectifier.
9. To provide an arrow tip canister comprising an accelerometer.
10. To provide an arrow construction system comprising a wireless transmitter.
11. To provide an arrow construction system comprising a wind tracking apparatus.
12. To provide an arrow construction system comprising a solar cell.
13. To provide an arrow construction system comprising a shaft with integrated wires.
14. To provide an arrow construction system comprising a shaft with an integrated coil.
15. To move weight to the front of an arrow to improve arrow flight.
16. To move sensitive circuitry to the front of an arrow to improve reliability.
17. To provide an arrow construction system comprising a shaft with electrical wires connecting the tip canister to the nock.
18. To provide an arrow construction system comprising a tip canister and a nock each having a socket to receive a wire cable having a standard connector on both ends to improve reliability, ease of assembly, and cost.
19. To provide a light source from an arrow that flashes and is energy efficient.
20. To provide an improved nock with integrated LED circuit and conductors.
21. To provide fletching which emit light.
22. To provide fletching which generate solar power.
23. To provide light emitting fletching having light emitting film.
24. To provide light emitting fletching having light emitting fibers.
25. To provide various arrow tracker embodiments to charge the light source.
26. To provide a bow mounted magnet able to switch on the light.
27. To provide a bow mounted magnet able to charge the power circuit.
28. To enable archers to easily track and find shot arrows.
29. To enable means and methods of tracking arrows with minimal cost and waste.
30. To provide a simple way to manufacture arrows with affixed circuits and lights.
31. To provide means and methods to allow hunters to track animals they have shot.
32. To provide an ideal tracking solution for users such as hunters, who need a simple method of tracking arrows.
33. To provide a simple, no hassle means of lighting an arrow.
34. To provide a method to visualize the trajectory path of an arrow.
35. To empower a less skilled archer to track and monitor arrows.
36. To provide a means and method of tracking arrows that are reusable.
37. To provide an arrow tracker that requires very little maintenance.
38. To provide means and methods to track arrows that is portable.
39. To provide an inexpensive means of tracking arrows.
40. To provide an arrow tracker that uses simple electronics that are inexpensive and widely available.
41. To provide a more efficient way to track arrows.

42. To provide a wireless means of tracking arrows.
43. To provide a wireless means of switching on LED and/or audio.
44. To provide a portable means of tracking arrows.
45. To provide an arrow tracker that requires no setup.
46. To provide a more effective way of finding game.
47. To provide a method to track arrows in low visibility conditions.
48. To provide an easy to store arrow tracker.
49. To provide a lightweight arrow tracker.

DRAWING FIGURES

In the drawings, closely related figures have the same number but different alphabetic suffixes.

Figure 8A:
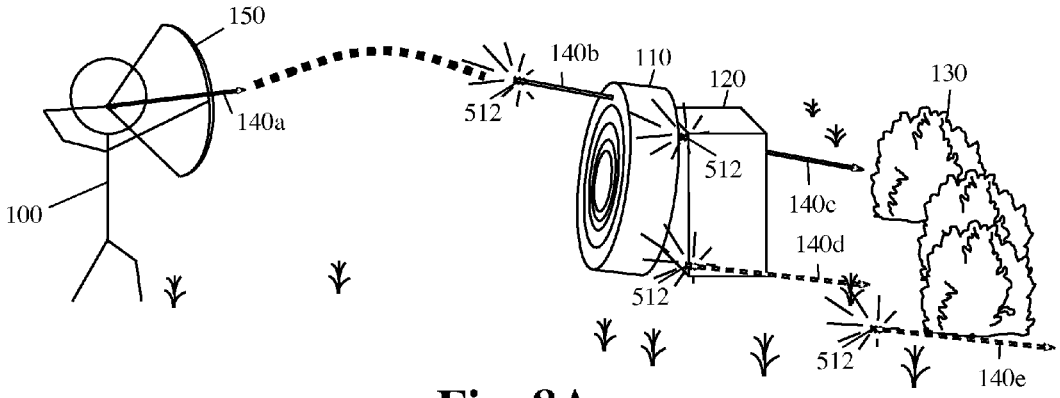

FIG. 8A portrays the benefits of the invention on the arrow allowing otherwise lost arrows to be easily found.

Figure 8B:
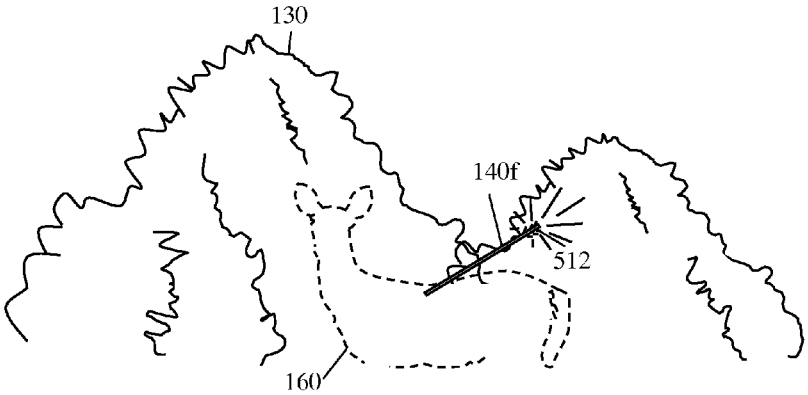

FIG. 8B illustrates how otherwise hidden prey can be found using the invention.

REFERENCE NUMERALS IN DRAWINGS

100 archer
110 target
120 hay bale
130 bushes
140*a-f* arrow
142*a-d* lost arrow
150 bow
160 deer
200 shaft
210 arrow tip
220 tip canister
230 tip receptacle
240 fletching
242 light emitting fletching
250 nock
260 positive contact
262 nock positive contact
270 negative contact
272 nock negative contact
280*a-b* thread receptor
282 connector
284 socket
286 wire
310 integrated positive wire
320 integrated negative wire
400 inserted coil
401 integrated coil
410 positive wire

420 negative wire
500 power circuit
502 coil
504 rectifier
506 power source
508 resistor
510 LED circuit
512 LED
520 flash circuit
530 audio circuit
540 transistor
550 capacitor
610 battery
620 switch
630 switch circuit
640 solar cell
642 fiber optic
650 wireless transmitter
660 wireless transceiver
670 sensors
680 wind tracking apparatus
690 accelerometer
700 magnet
710 string
720 limb
730 handle
750 north magnet
760 south magnet
770 fall away arrow rest

DESCRIPTION OF THE INVENTION

The present invention provides an arrow construction system comprising a tip canister 220 configured to receive an arrow tip 210 and to attach to an arrow shaft 200 with other components described below. The tip canister 220 may contain a power source 506 and sensitive electronics. The tip canister 220 moves the weight associated with components of a power circuit 500 and other electronics to the front of the arrow 140 improve both arrow flight and reliability. The power circuit 500 may comprise a battery 610, a storage capacitor 550, a coil 502 and a rectifier 504, and/or a solar cell 640. The tip canister 220 may be electrically connected to a nock 250 via the shaft. The electrical connections or wires 286 may pass through a hollow arrow shaft 200 or may be integrated into the shaft 200 for more reliability, ease of assembly, and lower cost. The wires 286 may form a cable with standard connectors 282, such as RJ11 telephone connectors. The cable may further comprise a coil 502. The nock 250 may contain a light, such as an LED (light emitting diode) 512. Alternatively, the fletching 240 may comprise light emitting film or fibers. Further fletching 240 may comprise a solar cell 640 (or photovoltaic cell), for example, in the form of a solar electric film. The electronics may include various circuits, such as a flash circuit 520, an audio circuit 530, a wireless transmitter 650 (such radio beacon), a wireless transceiver 660, sensors 670 (such as a wind tracking apparatus 680), a switch 620 and/or a GPS device. The switch 620 may be activated by a current detected in a coil 502 or by an accelerometer 690. Current may be generated in a coil 502 by passing the arrow 140 through a magnetic field.

The Problem of Lost Arrows

FIG. 1A

Figure 1A:
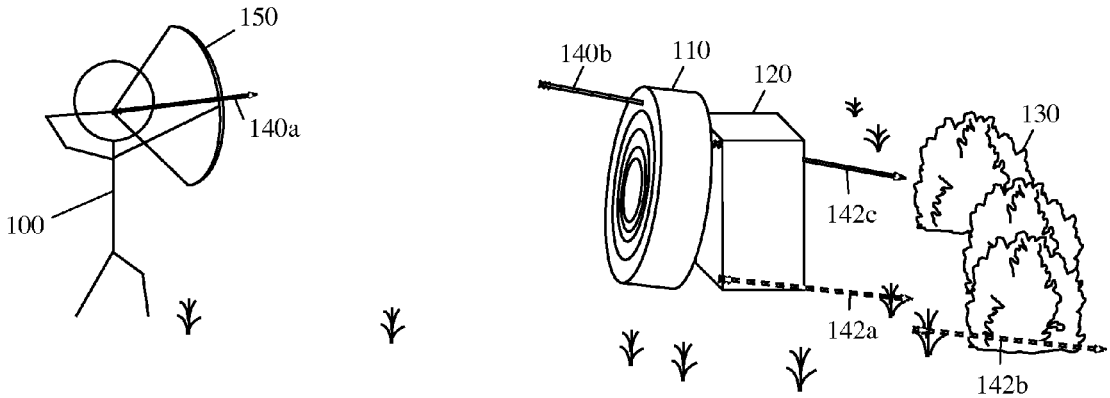
FIG. 1A illustrates examples arrows being lost while firing at a target.

FIG. 1A shows examples of places that arrows can be lost while firing at a target. When an archer 100 shoots arrows 140*a-b* with a bow 150 they can become lost arrows 142. Lost arrow 142*a* is shown lost under the target 110 and its supporting hay bale 120. Lost arrow 142*b* is shown hidden in the bushes 130. Lost arrow 142*c* is shown having passed completely through the target 110 and deep inside the hay bale 120. It is common for arrows 140 to become lost. When this happens in an archery range, not only does it take time away from shooting by the archer, but, when other archers are also shooting, they must wait while the search continues for lost arrows. The present invention provides improved means and methods for constructing arrows so that they can be found more rapidly at the archery range.

FIG. 1B

Figure 1B:
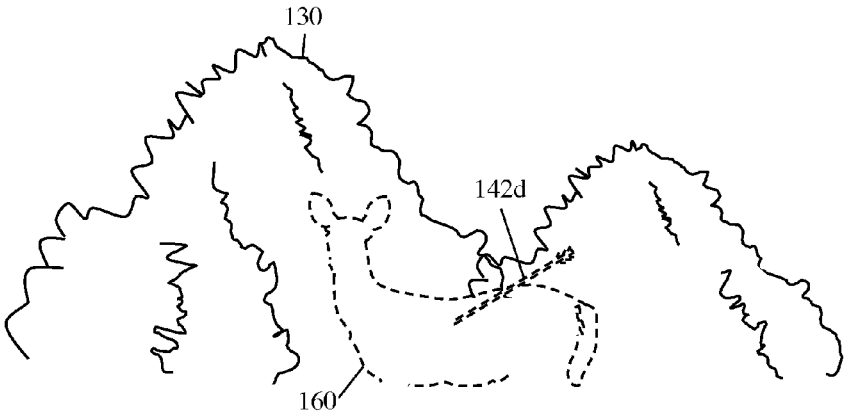
FIG. 1B illustrates an example of how a live target can be hidden even after being hit by an arrow.

FIG. 1B shows an example of how a live target can be hidden even after being hit by an arrow. When hunting a live target, such as a deer 160, the live target may be hit and then move to cover making it difficult to find. FIG. 1B shows a deer 160 obscured by the bushes 130 even though the lost arrow 142*d* hit the deer 160. The present invention provides improved means and methods for constructing arrows so that they can be found more rapidly when in the wild and, in particular, can help find game that has been shot.

Arrow Construction Systems Having Tip Canisters

FIG. 2A

Figure 2A:
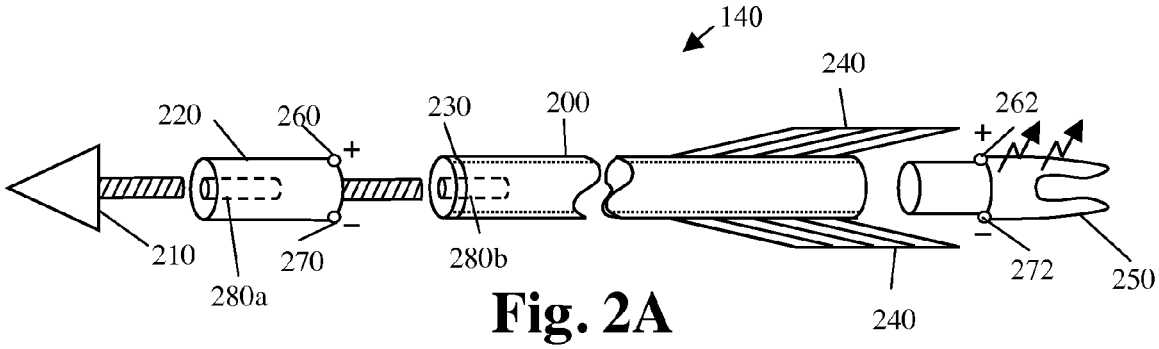
FIG. 2A illustrates an embodiment of an arrow constructed with a tip, a threaded tip canister with positive and negative contacts, a hollow shaft having electrical wires, fletching, and a light emitting nock on the tail.

FIG. 2A illustrates an embodiment of an arrow 140 constructed with an arrow tip 210, a tip canister 220, a shaft 200 having a electrical conduction subsystem, fletching 240, and a light emitting nock 250 on the tail.

In this embodiment, the arrow tip 210 is configured to attach to the arrow shaft 200 using a standard threaded tip receptacle 230. The novel tip canister 220 is configured with a thread receptor 280*a* so that it can receive the arrow tip 210. In this embodiment the tip canister 220 is configured with threads to attach to the arrow shaft 200 using the standard threaded tip receptacle 230 in place of the arrow tip 210 at thread receptor 280*b*. The arrow shaft 200 is shown as a hollow shaft made, for example, of fiberglass, carbon fiber, or composite fiberglass and metal. The tip canister 220 also comprises a positive contact 260 and a negative contact 270. The tip canister 220 may also contain one or more of a power circuit 500, a flash circuit 520, an audio circuit 530, a battery 610, a switch 620, a switch circuit 630, a solar cell 640, a wireless transmitter 650, a wireless transceiver 660 and/or sensors 670, such as a wind tracking apparatus 680 or an accelerometer 690. Fletching 240 is attached to the back (or tail end) of the arrow shaft 200 towards the tail of the arrow 140. The nock 250 attaches to the tail end of the arrow shaft 200 behind fletching 240. In this embodiment, the nock 250 is an illuminated nock 250 (for example, see FIG. 2C) with a nock positive contact 262 and a nock negative contact 272. The electrical conduction subsystem connects the tip canister positive contact 260 to the nock positive contact 262 and connects the tip canister negative contact 270 to the nock negative contact 272 via the shaft 200. For examples of shaft electrical conduction subsystems see FIGS. 3A, 3B, 3C, and 3E.

FIG. 2B

Figure 2B:
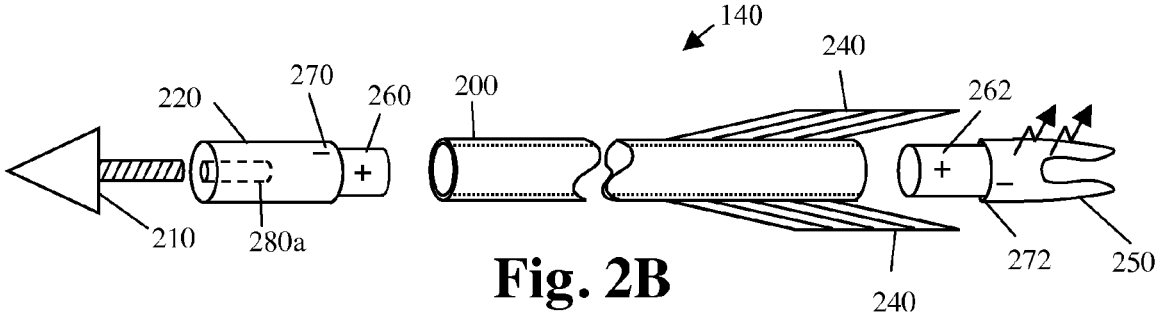
FIG. 2B illustrates an embodiment of an arrow constructed with a tip, a tip canister with positive and negative contacts, a hollow shaft having integrated wires with positive inside and negative outside, fletching, and a light emitting nock on the tail.

FIG. 2B illustrates an embodiment of an arrow 140 constructed with an arrow tip 210, a tip canister 220, a shaft 200 having a electrical conduction subsystem comprising integrated wires with positive inside and negative outside, fletching 240, and a light emitting nock 250 on the tail end.

In this embodiment, the arrow tip 210 is configured to attach to the novel tip canister 220 with a thread receptor 280*a*. In this embodiment, the tip canister 220 is configured to attach to the hollow arrow shaft 200 with an insertion cylinder with an outer diameter that matches the inner diameter of the arrow shaft 200. For example, see the embodiment in FIG. 3D. The insertion cylinder forms a positive contact 260. The tip canister 220 also comprises a sleeve that fits over the arrow shaft 200. The sleeve comprises a negative contact 270. The arrow shaft 200 is shown as a hollow shaft. In this embodiment, the electrical conduction subsystem comprises a negative conductor on the outside of the arrow shaft 200 and a positive conductor on the inside of the arrow shaft 200. For example, see the shaft electrical conduction subsystem of FIGS. 3C and 3E. The tip canister 220 may also contain one or more of a power circuit 500, a flash circuit 520, an audio circuit 530, a battery 610, a switch 620, a switch circuit 630, a solar cell 640, a wireless transmitter 650, a wireless transceiver 660 and/or sensors 670, such as a wind tracking apparatus 680 or an accelerometer 690. Fletching 240 is attached to the back of the arrow shaft 200 towards the tail of the arrow 140. The nock 250 attaches to the tail end of the arrow shaft 200 behind fletching 240. In this embodiment, the nock 250 is an illuminated nock with a nock positive contact 262 and a nock negative contact 272. The electrical conduction subsystem connects the tip canister positive contact 260 to the nock positive contact 262 and connects the tip canister negative contact 270 to the nock negative contact 272 via the shaft 200.

In another embodiment (not shown), the tip canister 220 could contain lights facing forward or sideways.

FIG. 2C

Figure 2C:
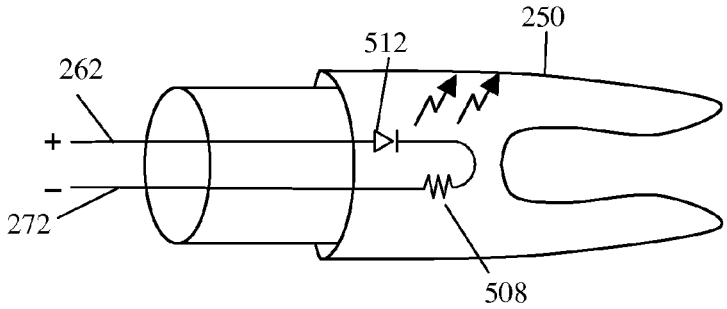
FIG. 2C illustrates LED circuitry integrated into a translucent nock.

FIG. 2C illustrates LED circuitry 510 integrated into a translucent nock 250.

FIG. 2C shows an embodiment of a novel nock with LED circuitry 510 embedded within the translucent material of the nock 250. The nock 250 comprises an LED 512 and a resistor 508 in series. In this embodiment, the nock positive contact 262 is connected to the LED 512 and the nock negative contact 270 is connected to the resistor 508. The nock 250 is preferably formed of molded plastic with the LED circuitry being embedded in the plastic while the plastic is liquid. This results in a durable component of an arrow construction system that can withstand significant shock, acceleration forces, and deceleration forces, and in low cost of production. The nock positive contact 262 and the nock negative contact 270 may be positioned to match the shaft electrical conduction subsystem, for example as shown is FIG. 2A, 2B, 2D or 3F.

FIG. 2D

Figure 2D:
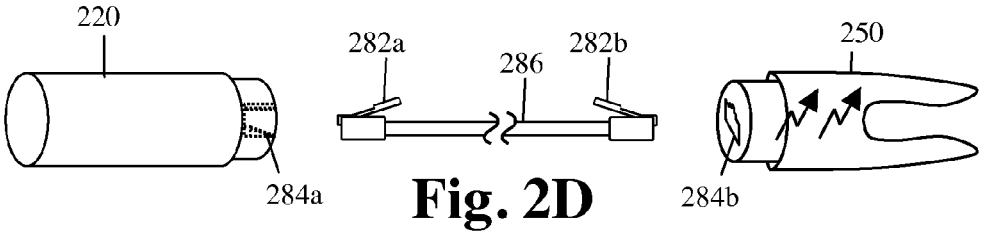
FIG. 2D illustrates an embodiment of arrow construction system comprising a tip canister and an illuminated nock having standard connector sockets for receiving, for example a standard telephone cable.

FIG. 2D illustrates an embodiment of an arrow construction system comprising a tip canister 220 and an illuminate nock 250 having standard connector sockets 284*a* and 284*b* (respectively) for receiving, for example a standard telephone cable.

In this embodiment, the shaft electrical conduction subsystem comprises a small cable that is configured to pass through a hollow shaft 200 (not shown). In this example, the cable comprises two connectors 282 and wires 286.

In one embodiment, the cable is a standard telephone cable using RJ11, 4P4C, or 4P2C connectors and sockets. A first connector 282*a* attaches to a socket 284*a* on tip canister 220. The wire 286 has connector 282*a* on one end and connector 282*b* on the other. The connector 282*b* connects to socket 284*b* on the nock 250.

This embodiment has the advantage of using standard cables that are in ready, low cost supply and can be easily replaced in the field. The locking connectors 282 and sockets 284 improve the reliability and maintainability of the arrow construction system in the field.

Further, custom length RJ11 or 4P4C cables can be made using low cost readily available materials and tools so that custom arrow makers can make custom length arrow shafts using these novel tip canisters 220 and nocks 250 having sockets.

In yet another embodiment, the cable could be a coaxial cable, for example like a cable TV cable with BNC connectors. In a BNC embodiment, the tip canister 220 would have a corresponding BNC socket 284.

Arrow Construction Systems Having Shaft Electrical Conduction Subsystems

FIG. 3A

Figure 3A:
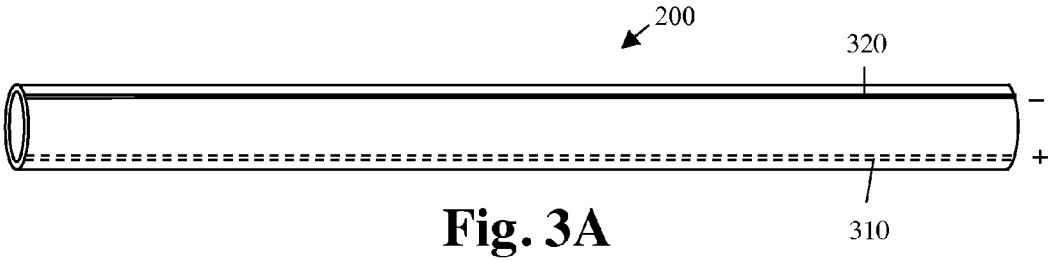
FIG. 3A illustrates an arrow shaft with integrated wires.

FIG. 3A illustrates a shaft electrical conduction subsystem comprising an arrow shaft 200 with integrated wires (310 and 320), one external and one internal, respectively.

In this embodiment, a hollow arrow shaft 200 contains internal positive wire 310 and external negative wire 320. Preferably the positive wire 310 and negative wire 320 are formed of a conductive trace formed on the internal and external surfaces, respectively, of the shaft 200. For example, the shaft 200 could be formed of insulating fiberglass with a metal or carbon filament conductor adhered along the shaft 200.

This embodiment has the advantage of ease of manufacture and high reliability.

Alternatively, in another embodiment, the positive wire 310 and negative wire 320 may be formed of standard wires, which are readily available, but which may make assembly more difficult.

The exemplary placement of the wires shown in FIG. 3A correspond to the placement of the tip canister positive contact 260, the nock positive contact 262 the tip canister negative contact 270 and the nock negative contact 272 as shown in FIG. 2A.

While FIG. 3A shows a hollow shaft 200, alternatively, the arrow shaft 200 could be solid with a plurality of external wires, including the positive wire 310 and negative wire 320 could be formed on the external surface of the shaft 200.

FIG. 3B

Figure 3B:
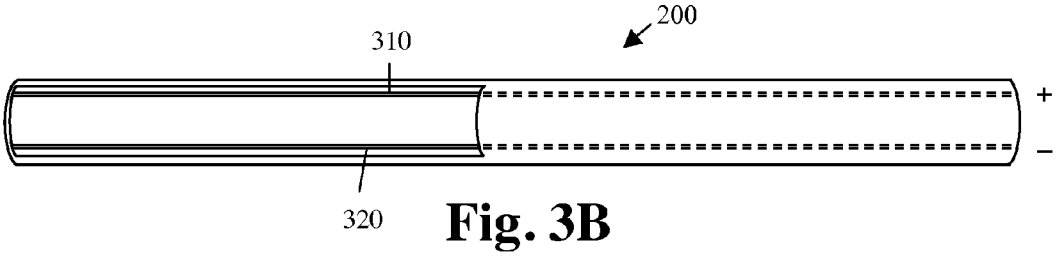
FIG. 3B illustrates an arrow shaft with integrated internal wires.

FIG. 3B illustrates a shaft electrical conduction subsystem comprising an arrow shaft 200 with integrated internal wires (310 and 320).

In this embodiment, a hollow arrow shaft 200 contains an internal positive wire 310 and internal negative wire 320 (as shown in the cutaway section of the figure). Preferably the positive wire 310 and negative wire 320 are formed of a conductive trace formed on the internal surfaces of the shaft 200. For example, the shaft 200 could be formed of insulating fiberglass with a metal or carbon filament conductor adhered along the shaft 200.

This embodiment has the advantage of ease of manufacture and high reliability.

Having both wires (310 and 320) internal improve the reliability over the embodiment of FIG. 3A.

Alternatively, in another embodiment, the positive wire 310 and negative wire 320 may be formed of standard wires, which are readily available, but which may make assembly more difficult.

The exemplary placement of the wires shown in FIG. 3B correspond to the placement of the tip canister positive contact 260, the nock positive contact 262 the tip canister negative contact 270 and the nock negative contact 272 as shown in FIG. 2A.

FIG. 3C through FIG. 3F

Figure 3C:
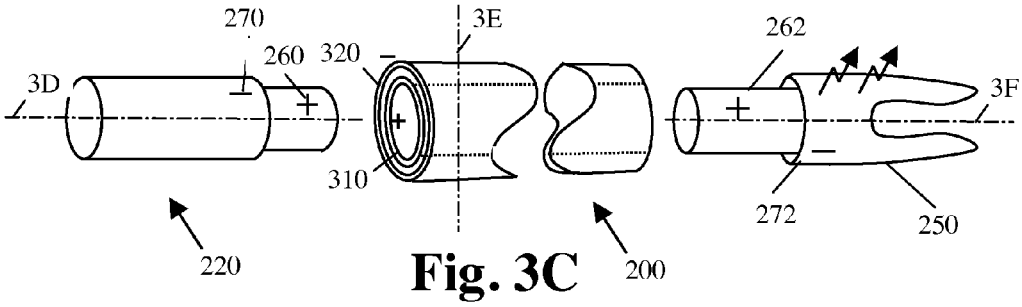
FIG. 3C illustrates an arrow shaft with an inner positive conductor and an outer negative conductor with corresponding tip canister and illuminated knock.

FIG. 3C illustrates an embodiment of an arrow construction system comprising a novel tip canister 220, a novel shaft electrical conduction subsystem, and an illuminate nock 250.

Figure 3D:
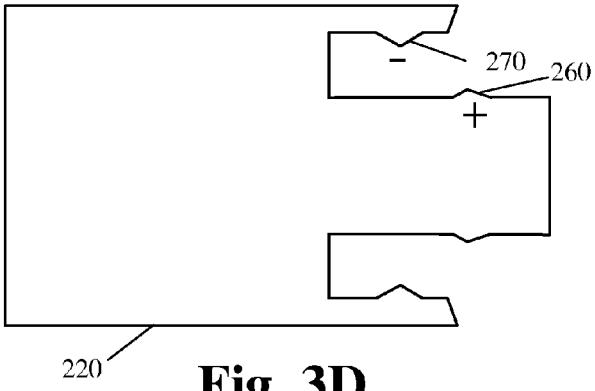
FIG. 3D illustrates a cross section of the tip canister and illustrates a more detailed view of the positive and negative contacts.
Figure 3E:
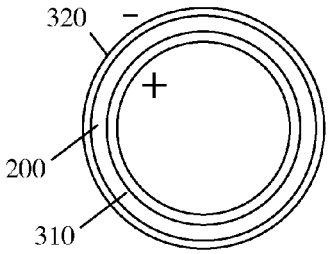
FIG. 3E illustrates a cross section of a shaft with integrated wires on the outside and inside.

FIG. 3C illustrates a shaft electrical conduction subsystem comprising an arrow shaft 200 with integrated conduction layers (310 and 320), one external and one internal, respectively. FIG. 3E shows a cross section of the shaft 200 shown in FIG. 3C.

In this embodiment, a hollow arrow shaft 200 contains internal positive wire 310 and external negative wire 320. Preferably the positive wire 310 and negative wire 320 are formed of a conductive trace formed on the substantially the entire internal and external surfaces, respectively, of the shaft 200. For example, the shaft 200 could be formed of insulating fiberglass with a metal or carbon filament conductor formed as a layer along the external and internal surfaces, respectively, of the shaft 200.

This embodiment has the advantage of ease of manufacture and high reliability.

Further, custom length shafts 200 can be made using these novel shaft 200 so that custom arrow makers can make custom length arrow shafts 200 using this novel shaft electrical conduction subsystem with integrated internal and external conduction layers (310 and 320).

FIG. 3C also shows a novel tip canister 220 configured to attach to the hollow arrow shaft 200 with an insertion cylinder with an outer diameter that matches the inner diameter of the hollow arrow shaft 200. The insertion cylinder forms a positive contact 260. The tip canister 220 also comprises a sleeve that fits over the arrow shaft 200. The sleeve comprises a negative contact 270. FIG. 3D shows a cross section of the tip canister 220 shown in FIG. 3C.

An arrow tip 210 may be connected to the tip canister 220 with a thread receptor 280 (as shown in FIG. 2B) or another means such as an insertion cylinder.

Figure 3F:
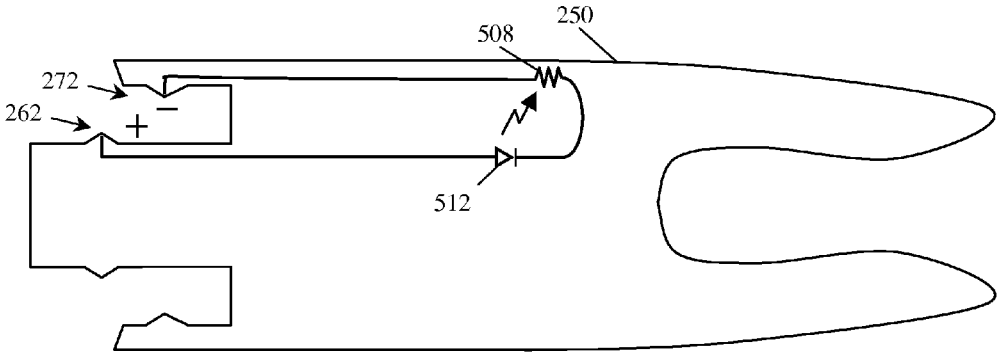
FIG. 3F illustrates a cross section of the nock.

FIG. 3C further shows a novel illuminated nock 250 configured to attach to the hollow arrow shaft 200 with an insertion cylinder with an outer diameter that matches the inner diameter of the hollow arrow shaft 200. The insertion cylinder forms a nock positive contact 262. The nock 250 also comprises a sleeve that fits over the arrow shaft 200. The sleeve comprises a nock negative contact 272. FIG. 3F shows a cross section of the nock 250 shown in FIG. 3C.

FIG. 3F shows details of the novel nock 250. The nock 250 comprises an LED 512 and a resistor 508 in series. In this embodiment, the nock positive contact 262 is connected to the LED 512 and the nock negative contact 270 is connected to the resistor 508. The nock 250 is preferably formed of molded plastic with the LED circuitry being embedded in the plastic while the plastic is liquid. This results in a durable component of an arrow construction system that can withstand significant shock, acceleration forces, and deceleration forces, and in low cost of production.

The internal and external placement of the electrical conductors shown in FIG. 3C correspond to the internal placement of the tip canister positive contact 260 and the nock positive contact 262 (see FIGS. 3D and 3F for more detail) and the external placement of the tip canister negative contact 270 and the nock negative contact 272 (see FIGS. 3D and 3F for more detail). This embodiment provides improved ease of assembly and reliability over the shaft electrical conduction subsystem embodiment shown is FIG. 3A, because the contacts (260, 262, 270, and 272) do not need to be lined up with the wires (310 and 320).

Further, the arrow construction system shown in FIG. 3C allows custom arrow makers can make custom length arrow shafts 200 with integrated conductors which can easily be assembled with novel tip canisters 220 and novel nocks 250 making reliable electrical connections.

Novel Light Emitting and Solar Cell Fletching

FIG. 3G

Figure 3G:
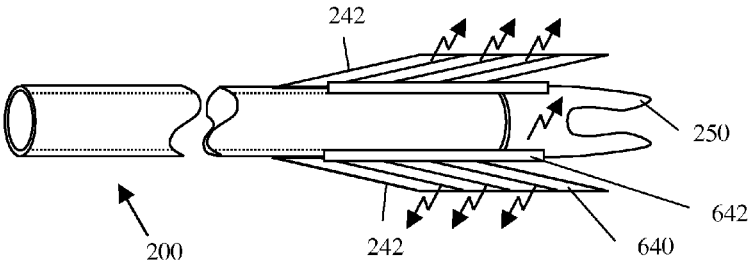
FIG. 3G illustrates an arrow shaft and nock with fletching that has LED lights and optional solar electric film.

FIG. 3G illustrates various embodiments an arrow shaft 200 and nock 250 with light emitting fletching 242 and optional solar cell 640 film.

In one embodiment, as shown, each vane of the light emitting fletching 242 comprises fiber optics 642 that carry the light emitted from the illuminated nock 250 to individual fibers in the vane.

In another embodiment, each vane of the light emitting fletching 242 comprises film that contains LEDs (light emitting diodes). In this embodiment, the nock 250 need not be illuminated.

Figure 6A:
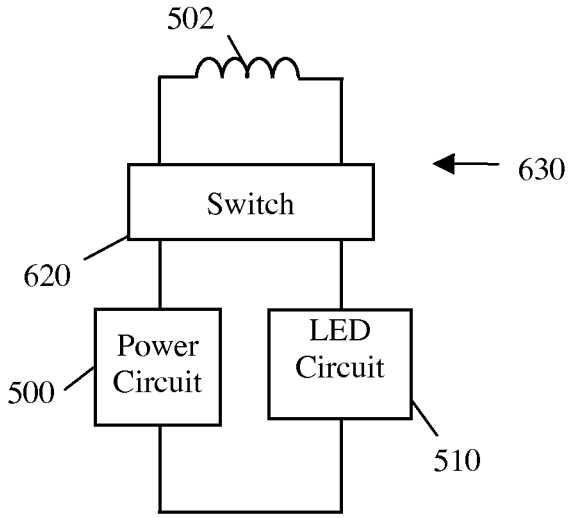
FIG. 6A illustrates a circuit having a coil activating a switch to a LED circuit.
Figure 6B:
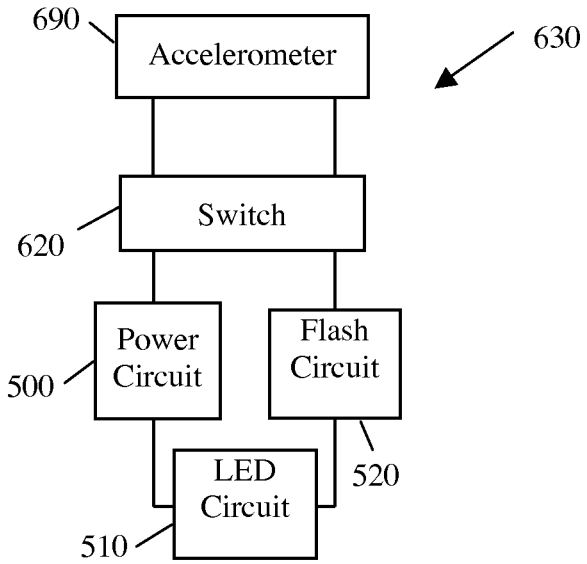
FIG. 6B illustrates a circuit having an accelerometer activating a switch to a flash circuit and LED.
Figure 6C:
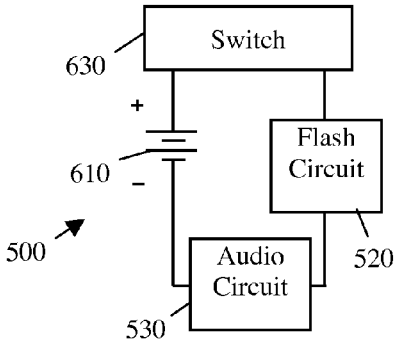
FIG. 6C illustrates a circuit comprising a switch, a battery, a flash circuit and an audio circuit.
Figure 6D:
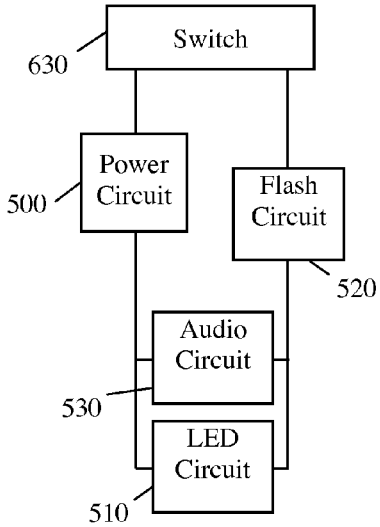
FIG. 6D illustrates a circuit comprising a power circuit, a switch, a flash circuit, and an audio circuit and LED circuit in parallel.
Figure 6E:
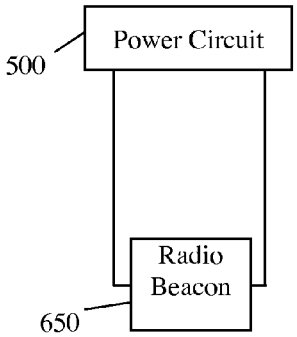
FIG. 6E illustrates a power circuit connected to a radio beacon.
Figure 6F:
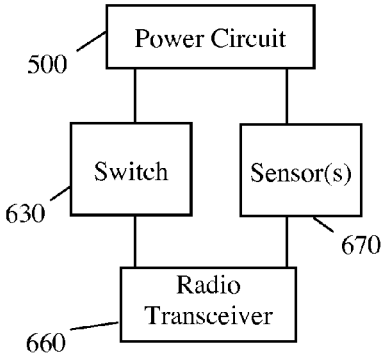
FIG. 6F illustrates a circuit comprising a power circuit, a switch, a radio transceiver and one or more sensors.
Figure 6G:
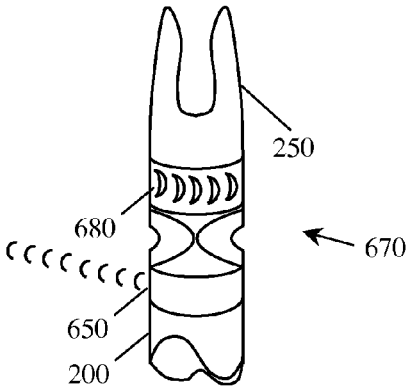
FIG. 6G illustrates an embodiment of arrow construction system comprising a wind tracking apparatus containing elements for calculating wind speed and direction, and transmitting the data wirelessly.
Figure 6H:
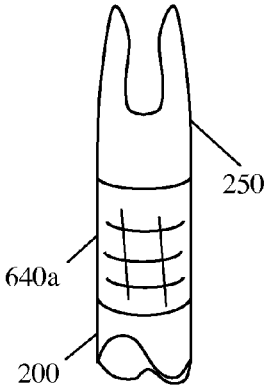
FIG. 6H illustrates an arrow with solar cells integrated with the shaft.
Figure 6I:
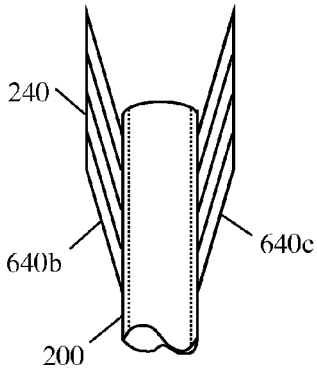
FIG. 6I illustrates solar cells on the fletching of an arrow.

In yet another embodiment, each vane of the fletching 240 comprises film that contains solar cells 640 (see FIG. 6I). Preferably the vanes are made of a solar cell 640 film. The electrical connections for the solar cell 640 may travel along the shaft 200 via the shaft electrical conduction subsystem to a means for storing the power. Alternatively, the solar cell 640 can have a direct connection to the illuminated nock 250 and provide continuous illumination while the sun or a light is charging the solar cell 640.

In yet another embodiment, the solar cell 640 may comprise film adhered to the external surface of the arrow shaft 200.

Coils Configured Along a Shaft

Figure 4A:
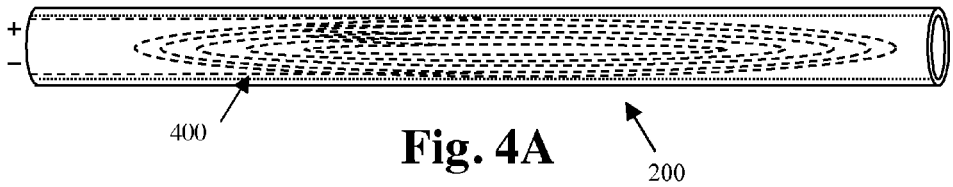
FIG. 4A illustrates an arrow shaft with an inserted coil.
Figure 4B:
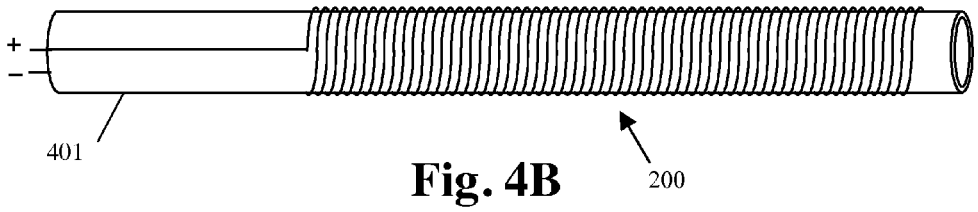
FIG. 4B illustrates an arrow shaft with an external coil.
Figure 4C:
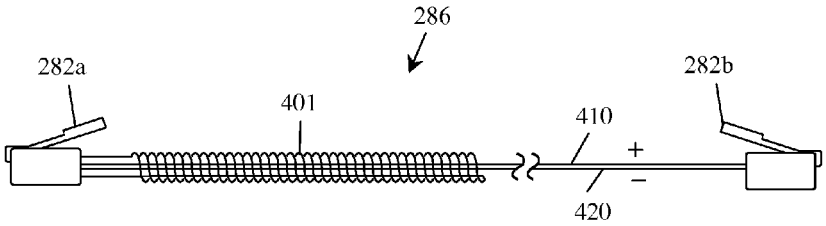
FIG. 4C illustrates a shaft electrical conduction subsystem comprising a cable with a coil, positive and negative wires, and connectors on each end.
Figure 5A:
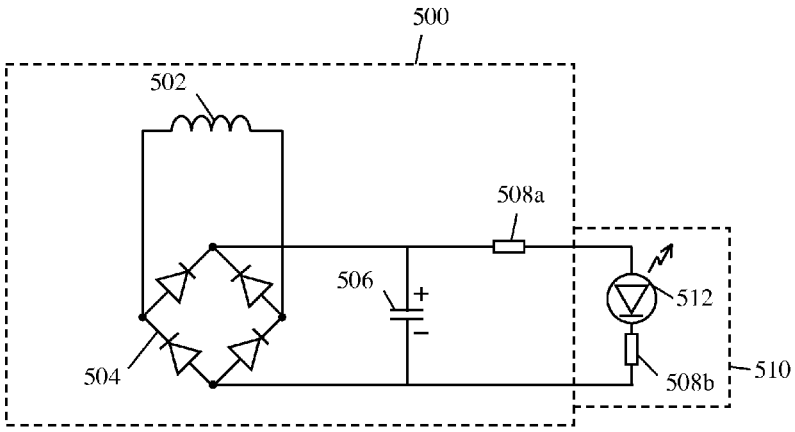
FIG. 5A illustrates a circuit comprising a power circuit, comprising a coil, a rectifier, and a power source; and a LED circuit.
Figure 7A:
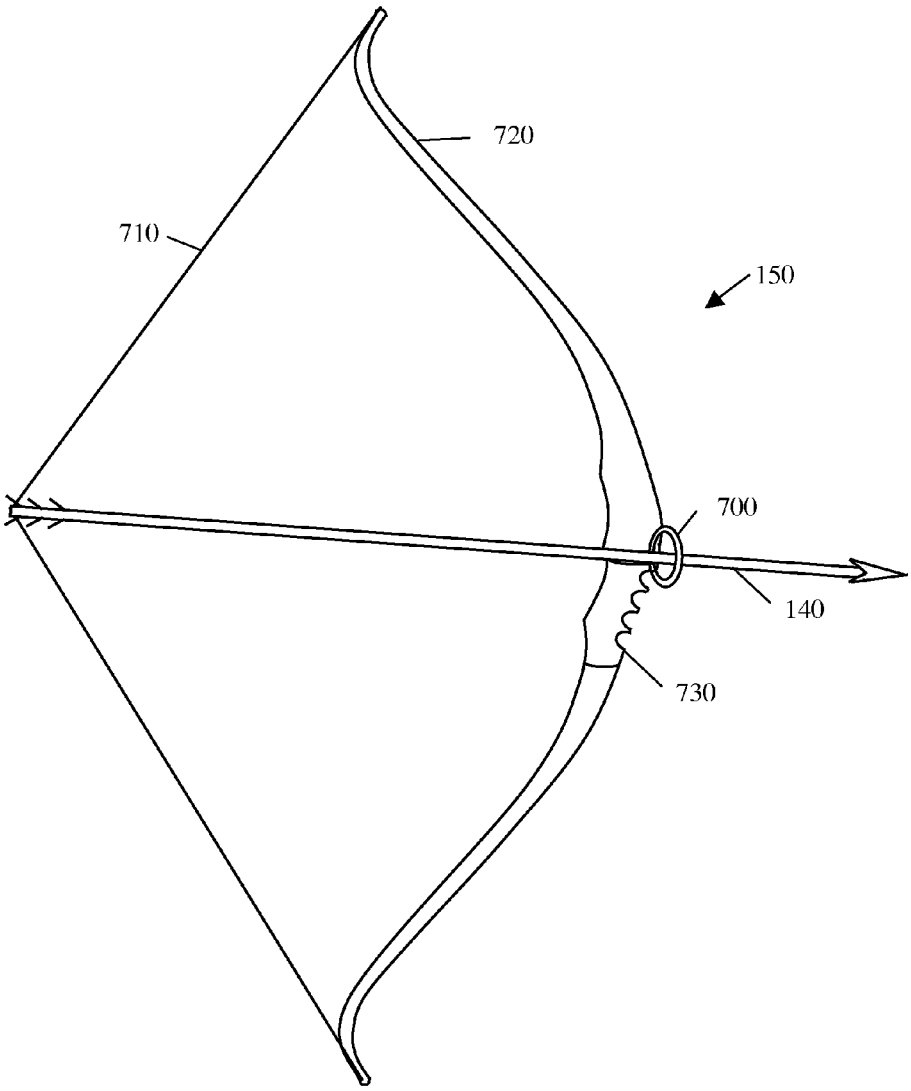
FIG. 7A illustrates a side view of an arrow passing through a magnet mounted on a bow.
Figure 7B:
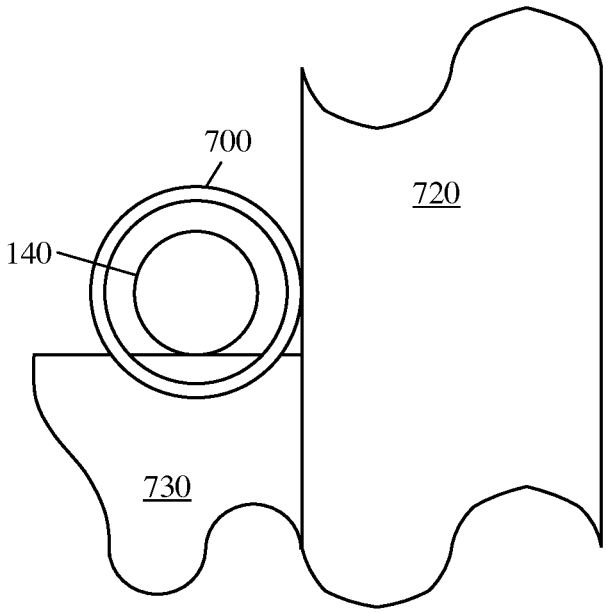
FIG. 7B illustrates a front view of an arrow passing through a magnet mounted on a bow.
Figure 7C:
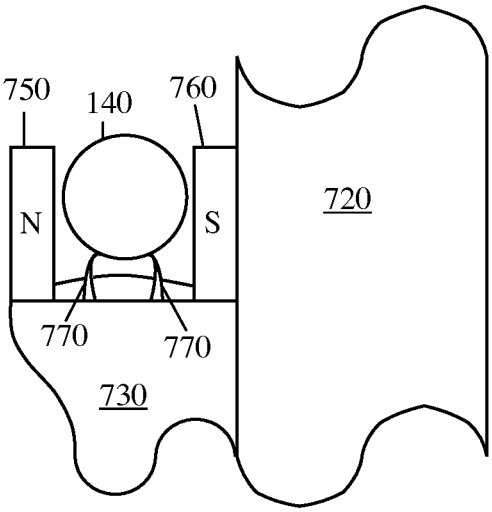
FIG. 7C illustrates a front view of an arrow passing through a plurality of magnets mounted on a bow.

Novel arrow construction systems may also comprise various coils 502 for charging a power source 506 (e.g. FIG. 5A) or for electrically triggering a switch 620 (e.g. FIG. 6A). FIGS. 4A through 4C shows different coil (400, 401) configurations. FIGS. 7A through 7C show embodiments of magnets (700, 750, 760) mounted on a bow, so that the arrow shaft 200 coils 502 are passed through a magnetic field when the arrow 140 is shot.

FIG. 4A

FIG. 4A illustrates a hollow arrow shaft 200 with an inserted coil 400.

FIG. 4B

FIG. 4B illustrates an arrow shaft 200 with an external integrated coil 401. In this embodiment, the coil wire is coiled around the arrow shaft 200. Preferably the wire is coiled tightly or covered with a filler, such as paint or resin, or a film so the arrow shaft 200 has a smooth aerodynamic surface.

FIG. 4C

FIG. 4C illustrates a shaft electrical conduction subsystem comprising a cable with an integrated coil 401, a positive wire 410, a negative wire 420, and connectors 282 on each end. Wires 286 comprises a positive wire 410 and a negative wire 420, both surrounded by integrated coil 401 and connected to connectors 282*a-b* are on either end. The coil 401 is only connected to one connector 282*a*. The connectors 282*a-b* are preferably standard connectors such as telephone connectors. This embodiment is compatible with the arrow construction system shown for example in FIG. 2D. When combined, the integrated coil 401 would be connected to the circuitry inside the tip canister 220.

In another embodiment, the integrated coil 401 could be connected to a single connector 282*a* without the positive wire 410 or the negative wire 420.

In yet another embodiment, the cable is a coaxial cable, for example, a cable TV cable with BNC connectors. In a BNC embodiment, the tip canister 220 would have a corresponding BNC socket 284.

Arrow Construction System Circuits

Various electronic circuits may be used in various combinations in arrow construction systems. All or part of the circuit may be contained in tip canister 220. In most embodiments, some portion of the circuit will be located in the tip canister 220 and other portions will be attached to the tail end of the arrow such as light emitting fletching 242, solar cell 640, or illuminated nock 250. In distributed circuits, an embodiment of a shaft electrical conduction subsystem is used to connect the tip canister 220 portion to the tail portion (e.g. nock 250 or tail canister).

FIG. 5A

FIG. 5A illustrates a circuit comprising a power circuit 500 comprising a coil 502, a rectifier 504, and a power source 506, and a LED circuit 510.

In this embodiment, the power circuit 500 comprises the rectifier 504, which converts the AC current of the coil 502 into DC current, which is stored in the power source 506. The power is released through the resistor 508*a* to the LED circuit. The LED circuit 510 comprises an LED 512 and resistor 508*b* in series.

When the coil 502 (e.g. in an arrow 140 either as an inserted coil 400 or an integrated coil 401) passes through a magnetic field (see FIGS. 7A through 7C) when the arrow 140 is shot, the current generated in the coil 502 is rectified and stored in the power source 506. The power source 506 could be a primary storage capacitor 550 (similar to FIG. 5F) or a battery 610 (similar to FIG. 5G). The power source 506 would be charged when the arrow is shot and would illuminate the LED 512 (e.g. in an illuminated nock 250) until the power is drained from the power source 506.

This embodiment has the advantage of not requiring a mechanical switch, which will improve reliability and simplify operation by the archer. The circuit is automatically activated whenever the arrow 140 is shot.

An embodiment with a primary storage capacitor 550 has advantages over embodiments with batteries 610: first, the weight of the battery is removed; and second, if the arrow 140 is lost, the heavy metals of the battery 610 would not be left in the wilderness to harm the environment.

FIG. 5B

Figure 5B:
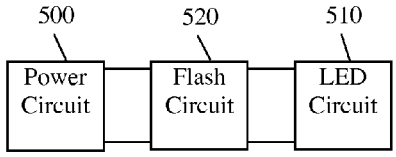
FIG. 5B illustrates a circuit comprising a power circuit, a flash circuit, and LED circuit to result in a flashing LED.

FIG. 5B illustrates a circuit comprising a power circuit 500, a flash circuit 520, and LED circuit 510 to result in a circuit with a flashing LED 512.

In one embodiment, a flash circuit 520 is inserted between the automatic power circuit 500 and LED circuit 510 as shown in FIG. 5A. In other embodiments, the power circuit is not automatic and is permanently powered when the battery 610 is inserted, when the capacitor 550 is charged from an external source, or when the power is switched on.

FIG. 5C

Figure 5C:
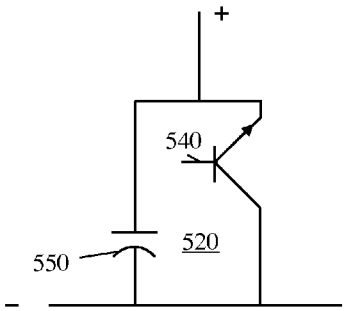
FIG. 5C illustrates a flash circuit and its components, comprising a transistor and a capacitor.

FIG. 5C illustrates a simple embodiment of a flash circuit 520, comprising a transistor 540 and a capacitor 550 wired as shown. The flash rate and duration are determined by the values of the transistor 540 and the capacitor 550. For example, when 12V power is supplied through a 1K resistor (not shown), a common NPN 2N2222 transistor 540 and a 330 uF capacitor 550 will produce a suitable flash rate. Other flash circuits are known in the art but require more components, and their associated weight and increased unreliability.

FIG. 5D

Figure 5D:
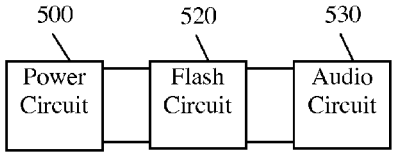
FIG. 5D illustrates a circuit comprising a power circuit, flash circuit and audio circuit to provide a flashing or beeping noise.

FIG. 5D illustrates a circuit comprising a power circuit 500, a flash circuit 520 and an audio circuit 530 to provide a flashing or beeping noise. The circuit of FIG. 5D is similar to the circuit of FIG. 5B except instead of powering an LED, it powers an audible noise.

In one embodiment, a flash circuit 520 is connected to an automatic power circuit 500 as shown in FIG. 5A. In other embodiments, the power circuit is not automatic and is permanently powered when the battery 610 is inserted, when the capacitor 550 is charged from an external source, or when the power is switched on.

FIG. 5E

Figure 5E:
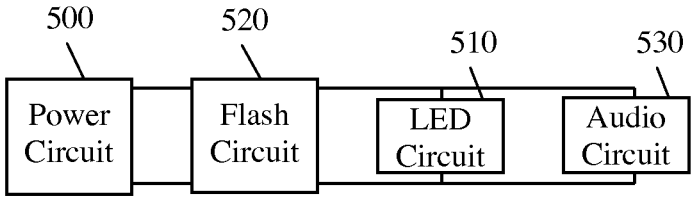
FIG. 5E illustrates a circuit comprising a power circuit, flash circuit, and LED circuit, and audio circuit in a flashing light combined with audio.

FIG. 5E illustrates a circuit comprising a power circuit 500, a flash circuit 520, and LED circuit 510, and audio circuit 530, resulting in a flashing light combined with audio.

FIG. 5E illustrates an optional configuration combining FIGS. 5B and 5D resulting in a flashing light with audio.

FIG. 5F

Figure 5F:
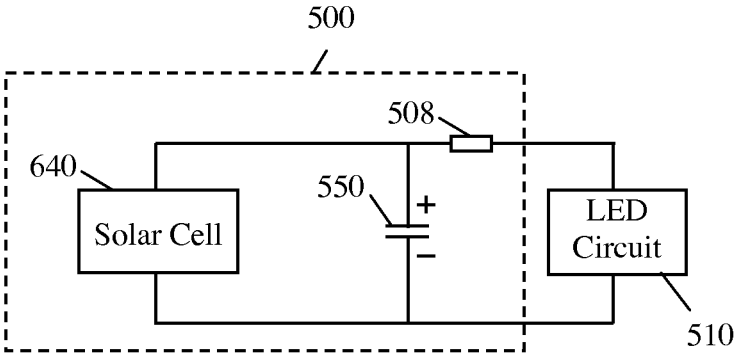
FIG. 5F illustrates a configuration wherein a power circuit, comprising a solar cell, capacitor, and resistor, is connected to an LED circuit.

FIG. 5F illustrates a circuit where a power circuit 500 comprises a solar cell 640, a storage capacitor 550, and a resistor 508. The power circuit 500 is shown connected to a LED circuit 510, but could also be connected to a flash circuit 520 and/or an audio circuit 530. This embodiment is similar to FIG. 5A but the power comes from a solar cell rather than coil 502, which has the advantage of working for an extending period of time. For example, if a arrow 140 with a solar powered circuit was lost on one day, the search could continue on another day, several days or even weeks later.

An embodiment with a storage capacitor 550 (e.g. FIG. 5F) has advantages over embodiments with batteries 610 (e.g. FIG. 5G): first, the weight of the battery is removed; and second, if the arrow 140 is lost, the heavy metals of the battery 610 would not be left in the wilderness to harm the environment. In this case, the storage capacitor 550 is the primary power source (i.e. it is distinct from capacitors that server other purposes in the circuit such as to smooth the voltage, or creating a flash circuit, such as in FIG. 5C).

FIG. 5G

Figure 5G:
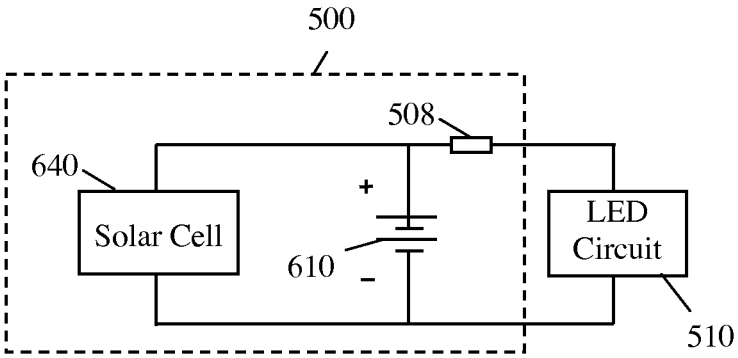
FIG. 5G illustrates a configuration wherein a power circuit, comprising a solar cell, battery, and resistor, is connected to an LED circuit.

FIG. 5G illustrates a circuit where a power circuit 500 comprises a solar cell 640, a rechargeable battery 610, and a resistor 508. The power circuit 500 is shown connected to a LED circuit 510, but could also be connected to a flash circuit 520 and/or an audio circuit 530.

This embodiment is similar to FIG. 5A but the power comes from a solar cell rather than coil 502, which has the advantage of working for an extending period of time. For example, if a arrow 140 with a solar powered circuit was lost on one day, the search could continue on another day, several days or even weeks later.

Automatic Circuit Switch Activation

Various attempts have been made to preserve battery life by manually or automatically switching on power to an illuminated nock. Manual switching requires the archer to turn on the switch, typically at a critical time when the archer is focused on other things such as shooting technique or hunting. Automatic switching attempts have been plagued with unreliability because the switches fail to function some of the time or because the forces placed upon the arrow 140 damage the fragile switches.

FIG. 6A

FIG. 6A illustrates a circuit having a coil 502 activating a switch 620 which activates a power circuit 500 and an LED circuit 510. The coil 502 and the switch 620 form a switch circuit 630.

When the coil 502 (e.g. in an arrow 140 either as an inserted coil 400 or an integrated coil 401) passes through a magnetic field (see FIGS. 7A through 7C) as the arrow 140 is shot, the current generated in the coil 502 is detected electronically by the switch 620.

This embodiment has the advantage of not requiring a mechanical switch, which will improve reliability and simplify operation by the archer. The circuit is automatically activated whenever the arrow 140 is shot.

The embodiment of FIG. 6A powers a LED circuit 510, but could also power other circuits with the elements shown for example in FIG. 5B, 5D, 5E, 6C, 6D, 6E or 6F.

FIG. 6B

FIG. 6B illustrates a circuit having an accelerometer 690 activating a switch 620 which activates a power circuit 500 and flash circuit 520 which in turn powers an LED circuit 510. The accelerometer 690 and the switch 620 form a switch circuit 630.

The accelerometer 690 (e.g. mounted in a tip canister 220) electronically detects first, an acceleration when the arrow 140 is shot, and second, a deceleration when the arrow 140 hits something. The accelerometer 690 can be configured to automatically switch on the LED circuit 510 (or optionally an audio circuit 530) at either event.

In a preferred embodiment (not shown), the accelerometer 690 turns on a flashing LED circuit 510 upon acceleration and turns on an audio circuit 530 upon deceleration. When hunting, the LED 512 allows the archer to see the path of the arrow 140 upon release and during flight, and the audio will not start until after the arrow 140 hits.

The embodiment of FIG. 6B powers a LED circuit 510, but could also power other circuits with the elements shown for example in FIG. 5B, 5D, 5E, 6C, 6D, 6E or 6F.

FIG. 6C

FIG. 6C illustrates a circuit comprising a power circuit 500, shown as a battery 610, a switch circuit 630, a flash circuit 520 and an audio circuit 530. This embodiment would result in a flashing noise or beeping when the switch is turned on. The switch circuit 630 could be an automatic switch (e.g. FIG. 6A or FIG. 6B) or a manual switch.

FIG. 6D

FIG. 6D illustrates a circuit comprising a power circuit 500, a switch circuit 630, a flash circuit 520, and an LED circuit 510 and an audio circuit 530 in parallel. This embodiment would result in a flashing light and noise or beeping when the switch is turned on. The switch circuit 630 could be an automatic switch (e.g. FIG. 6A or FIG. 6B) or a manual switch.

FIG. 6E

FIG. 6E illustrates a circuit comprising a power circuit 500 and a wireless transmitter 650, show as a radio beacon. The wireless transmitter 650, for example, could be a non-directional beacon (NDB) that could be homed in on using an automatic direction finder (ADF) receiver. The wireless transmitter 650 could transmit a continuous signal, or, to save power, could transmit a pulse signal at regular intervals.

FIG. 6F

FIG. 6F illustrates a circuit comprising a power circuit 500, a switch 630, one or more sensors 670, and a wireless transceiver 660, show as a radio transceiver. The wireless transceiver 660 receives and sends wireless communications. The wireless transceiver 660 could transmit a continuous signal, or, to save power, could transmit a pulse signal at regular intervals. The wireless transceiver 660 could transmit responses base on queries it receives.

The sensors 670 could be on one or more of a GPS, a digital video camera, a thermometer, a barometer, a moisture sensor, a humidity sensor, a wind direction sensor, and a wind speed sensor. For example, FIG. 6G shows an embodiment with wind tracking apparatus 680.

In one embodiment, the sensor 670 comprises a GPS sensor and transmits a GPS coordinate in response to a location request.

In another GPS embodiment, the path of the arrow 140, and any movement of the target is transmitted, so that archer can find the arrow and lost prey by following the same path, for example in dense brush or rough terrain.

In yet another GPS embodiment, the GPS location, wind and other atmospheric information is transmitted at regular intervals.

In yet another embodiment, the LED or audio circuits remain dormant until the wireless transceiver 660 receives a command to switch them on. Upon wireless receipt of the command, the LED and/or audio circuits are activated. Wirelessly activated circuits have the advantage of saving energy until location assistance is needed. On the archery range, this would have the advantage of not turning on the flash or beeps until all the arrows have been shot and the range is clear for the archers to retrieve their arrows. The beeping and flashing would otherwise be a distraction for those archers who are still shooting.

FIG. 6G

FIG. 6G illustrates an embodiment of arrow construction system comprising sensors 670, shown as a wind tracking apparatus 680 containing elements for calculating wind speed and direction; and a wireless transmitter 650.

In this embodiment, the wind tracking apparatus 680 is mechanical: wind direction is determined by a vane, and wind speed is determined by a wheel. In other embodiments, the wind tracking apparatus 680 could be opto-mechanical, for example having a optical fiber and an optical sensor; or non-mechanical, such as an ultrasonic anemometer. In the case of the ultrasonic anemometer, it could be comprised of three sensors mounted at the tail end of the fletching vanes.

FIG. 6H

FIG. 6H illustrates solar cells 640*a* integrated with an arrow shaft 200. In this embodiment, the solar cells 640*a* are shown as part of a tail canister between the arrow shaft 200 and the nock 250. Alternatively, the solar cells 640 could be solar film on the surface of the arrow shaft 200.

FIG. 6I

FIG. 6I illustrates solar cells 640 on fletching 240 of an arrow shaft 200.

Each vane of the fletching 240 comprises film that contains solar cells 640*b-c*. Preferably the vanes are made of a solar cell 640 film. The electrical connections for the solar cell 640 may travel along the shaft 200 to a means for storing the power. Alternatively, the solar cells 640 could be directly connected to an illuminated nock 250.

Various Circuit Combinations

The various circuit combinations shown and/or discussed above in reference to FIGS. 5A through 6I are exemplary to illustrate specific circuits that can be implemented as part of the arrow construction system. Further, the various circuit combinations illustrate that other circuits can be implemented in different combinations and not depart from the spirit and scope of the invention.

Automatically Passing a Coil through a Magnetic Field When an Arrow is Shot

FIGS. 7A through 7C show embodiments of magnets (700, 750, 760) mounted on a bow, so that the arrow shaft 200 coils 502 are passed through a magnetic field when the arrow 140 is shot. The coil 502 (e.g. FIG. 5A or FIG. 6A) is situated along the arrow shaft 200, either as an inserted coil 400 (e.g. FIG. 4A) or an integrated coil 401 (e.g. FIGS. 4B and 4C). When the coil 502 moves through the magnetic field, a current is generated in the coil 502. With a circuit as in FIG. 5A, the archer can charge the power source 506 by moving the arrow 140 through the magnetic field. This happens automatically when the arrow 140 is placed in on the bow 150, when the bow string 710 is pulled back, and when the bow string 710 is released. The archer could store an additional charge by moving the arrow 140 forward and back through any magnetic field, for example, the field associated with the magnets (700, 750, 760) mounted on the bow 150.

FIG. 7A

FIG. 7A illustrates a side view of an arrow 140 passing through a magnet 700 mounted on a bow 150. The bow 150 comprises a bow string 710, limbs 720, and a handle 730.

When the arrow 140 is placed through the magnet 700 a small current is generated. When the string 710 is pulled back, and released, it allows the arrow 140 to move through the magnet 700 while resting on handle 730. The magnet 700 is shown as a ring but could be a plurality of magnets as shown in FIG. 7C or another shape such as a horseshoe, which would allow the arrow 140 to drop through the magnet(s).

FIG. 7B

FIG. 7B illustrates a partial front view of the embodiment shown in FIG. 7A.

Arrow 140 rests on the top of handle 730, and passes through the ring magnet 700. The handle 730 is attached to the limbs 720 of the bow 150.

FIG. 7C

FIG. 7C illustrates a partial front view of another embodiment where the magnetic field is generated by a plurality of magnets, shown as north magnet 750 and south magnet 760.

Arrow 140 rests on two fall away arrow rests 770, on the handle 730 connected to limbs 720.

FIG. 8A

FIG. 8A portrays the benefits of the invention on the arrow 140 allowing otherwise lost arrows to be easily found.

When archer 100 shoots arrows 140*a-e* from his bow 150 at the target 110, sometimes his arrows aren't always in a visible spot like arrows 140*b*, which ended up in target 110. With LED 512 lights (or other embodiments), even otherwise lost arrows 140*c-e* obscured by bushes 130 and hay bale 120 will be able to be found.

FIG. 8B

FIG. 8B illustrates how previously hidden prey can be found using the invention.

Exemplary deer 160 is obscured by the bushes 130, but due to the LED 512 on arrow 140*f*, the prey will still be able to be found.

Advantages

Reliability

The tip canister, shaft electrical conduction subsystems, and integrated nock allow construction of arrows with electronics that are more reliable and durable than current electronics. Further, the automatic switching and charging features of various embodiments also improve the reliability and durability of the arrows systems.

Easy to Track

Because of the light (or audio or GPS) affixed to the arrow, when hunting or shooting at a range the present invention makes the arrow much easier to find. In hunting, when the archer has hit a target, the archer is able to follow the wounded prey.

Easy to Use

The arrow construction system is easy to use. Arrow manufactures, custom arrow markers, and archers can easily use the various components to make, or modify, arrows having superior features. In some embodiments, the arrow will light up or start broadcasting its location when it is fired.

In the coil charged or solar charged embodiments, batteries do not need to be replaced on a frequent basis.

Easy to Store

Because of its simple design, the components can be stored separately with minimal space used, or kept on the arrow or bow.

Better Battery Life

The present invention currently uses less power due to flashing circuits or interval transmissions. This allows for the arrow electronics to be used significantly longer. In the coil charged or solar charged embodiments, batteries can be eliminated.

Portable

The arrow components are lightweight and durable allowing for increased portability. Most embodiments do not require any extra equipment in order to be used.

Inexpensive

The components used in the circuitry are simple and cheap to manufacture; this makes both buying and replacing components cost-effective. Some circuits use less parts or eliminate batteries which reduce the electronics cost.

Lightweight

The design and nature of the components means the systems are extremely portable and lightweight.

Energy Efficient

The flashing nature of the LED, audio, or other circuits, as well as the fact that they are not triggered until fired means that the circuits run extremely efficiently and with minimal electrical use. Some embodiments are charged by solar cells and/or eliminate batteries keeping the environmental impact of the arrows very small and allowing for less circuitry and greater performance.

Easily Reused

The components can be reused over and over again without heavy deterioration or loss of function.

Little Maintenance

The circuitry has few parts and the system is efficient and long lasting. Little is required for the user in terms of effort put in to upkeep and replacement.

Empowering

To one without experience, it is often difficult to predict the movement of the arrows in flight. Tracking arrows becomes still more difficult when hunting in foggy, low-light or other visibility conditions. The flashing tracking system empowers archers of all skill levels to more easily observe arrow flight and to find arrows in various conditions.

More Efficient

The flashing light or audio is more easily visible or noticeable than conventional methods. The user will waste less time looking for arrows or wounded prey.

CONCLUSION, RAMIFICATION, AND SCOPE

Accordingly, the arrow construction system allows for arrows to be made or modified having superior features, reliability, and ease of use.

While the above descriptions contain several specifics these should not be construed as limitations on the scope of the invention, but rather as examples of some of the preferred embodiments thereof. Many other variations are possible. For example, the arrow construction system could be used to make spears or javelin that are thrown instead of shot from a bow. The various circuits could be implemented with various components while providing the same substantial functions. The variations could be used without departing from the scope and spirit of the novel features of the present invention.

Accordingly, the scope of the invention should be determined not by the illustrated embodiments, but by the appended claims and their legal equivalents.

The invention claimed is:

1. An arrow construction system for assembling an arrow, the arrow comprising an arrow tip and an arrow shaft having a tip end and a tail end, the arrow construction system comprising:

a) a tip canister configured to receive the arrow tip and configured to connect to the tip end of the arrow shaft, and b) a shaft electrical conduction subsystem configured along the arrow shaft, and c) a nock configured to connect to the tail end of the arrow shaft, wherein the tip canister comprises a tip canister thread receptor for receiving threads on the arrow tip, wherein the tip canister is configured to contain at least a portion of an electronic circuit, the electronic circuit comprising a power circuit and flash circuit, wherein the nock is formed of translucent plastic, wherein the nock is configured to contain a second portion of the electronic circuit, the second portion of the electronic circuit comprising a light emitting diode, and wherein the shaft electrical conduction subsystem connects a plurality of wires from tip canister contacts to nock contacts, whereby the power from the power circuit and flash circuit in the tip canister is transmitted via the shaft electrical conduction subsystem wires to the light emitting diode in the nock, cause the light emitting diode to flash.

2. The arrow construction system of claim 1, wherein the shaft electrical conduction subsystem comprises a cable configured to pass through the arrow shaft, the shaft cable having a tip canister connector and a nock connector, wherein the tip canister comprises an socket wherein the tip canister socket is configured to make an electrical connection with the tip canister connector of the shaft cable, and wherein the nock comprises an socket wherein the nock socket is configured to make an electrical connection with the nock connector of the shaft cable.

3. The arrow construction system of claim 1, wherein the tip canister comprises a battery.

4. An arrow construction system for assembling an arrow, the arrow comprising an arrow tip and an arrow shaft having a tip end and a tail end, the arrow construction system comprising:

a) a tip canister configured to receive the arrow tip and configured to connect to the tip end of the arrow shaft, and b) a shaft electrical conduction subsystem configured along the arrow shaft, wherein shaft electrical conduction subsystem comprises at least two separate conductors, and wherein the tip canister is configured to contain at least a portion of an electronic circuit.

5. The arrow construction system of claim 4, further comprising a nock, wherein the nock is configured to contain a second portion of the electronic circuit, and wherein the shaft electrical conduction subsystem connects a plurality of wires from tip canister contacts to nock contacts.

6. The arrow construction system of claim 5, wherein the nock is formed of translucent plastic, and wherein the second portion of the electronic circuit comprises a light emitting diode embedded in the translucent plastic of the nock.

7. The arrow construction system of claim 4, wherein the tip canister comprises a tip canister thread receptor for receiving threads on the arrow tip.

8. The arrow construction system of claim 4, wherein the tip canister comprises threads wherein the tip canister threads are configured to make an attachment with the arrow shaft having an arrow shaft thread receptor.

9. The arrow construction system of claim 4, wherein the tip canister comprises an insertion cylinder wherein the tip canister insertion cylinder is configured to make an attachment with the hollow arrow shaft.

10. The arrow construction system of claim 9, wherein the shaft electrical conduction subsystem comprises a cable configured to pass through the hollow arrow shaft, the shaft cable having a tip canister connector, wherein the tip canister comprises an socket, and wherein the tip canister socket is configured to make an electrical connection with the tip canister connector of the shaft cable.

11. The arrow construction system of claim 10, wherein the shaft cable is a telephone cable, and wherein the tip canister connector of the shaft cable is a telephone connector.

12. The arrow construction system of claim 4, further comprising a light emitting fletching.

13. The arrow construction system of claim 4, further comprising a coil configured along the arrow shaft.

14. The arrow construction system of claim 13, wherein the electronic circuit comprises power circuit, wherein the power circuit comprises the coil, a rectifier, and a power source, and wherein the coil and the rectifier generate current when passed through a magnetic field and store the resulting power in the power source, whereby the power source is charged when the arrow is shot.

15. The arrow construction system of claim 13, wherein the electronic circuit comprises switch circuit, wherein the switch circuit comprises the coil and a non-mechanical switch, and wherein the coil generates current when passed through a magnetic field and the switch detects the current and then activates, whereby the electronic circuit automatically activates when the arrow is shot.

16. The arrow construction system of claim 4, wherein the electronic circuit comprises power circuit, wherein the power circuit comprises a solar cell, and wherein the solar cell is configured as one of the group of:

i) solar cell film on the fletching, ii) solar cell film on the external surface of the arrow shaft, iii) a tip canister solar cell, and iv) a tail canister solar cell, whereby the electronic circuit is charged when light hits the solar cell.

17. The arrow construction system of claim 4, wherein the electronic circuit comprises one of the group of:

i) an audio circuit, ii) a wireless transmitter, iii) a radio beacon, iv) a wireless transceiver, v) a GPS receiver, vi) a wind sensor, vii) a thermometer, viii) a barometer, ix) a humidity sensor, and x) a digital video camera.

18. The arrow construction system of claim 4, further comprising a tail canister, wherein the tail canister is configured to contain a second portion of the electronic circuit.

19. The arrow construction system of claim 4, wherein the electronic circuit stores primary power in a storage capacitor.

20. An arrow construction system for assembling an arrow, the arrow comprising an arrow tip and an arrow shaft having a tip end and a tail end, the arrow construction system comprising:

a) a tip canister configured to receive the arrow tip and configured to connect to the tip end of the arrow shaft, and b) a shaft electrical conduction subsystem configured along the arrow shaft, wherein the tip canister is configured to contain at least a portion of an electronic circuit, and wherein the shaft electrical conduction subsystem comprises a plurality of wires integrated into the arrow shaft.

21. The arrow construction system of claim 20, wherein at least one of the plurality of integrated wires is an integrated positive wire on the inside of the arrow shaft, the arrow shaft being hollow.

22. The arrow construction system of claim 21, wherein the integrated positive wire is a conductive trace adhered to the internal surface of the hollow arrow shaft.

23. The arrow construction system of claim 22, wherein the tip canister comprises an insertion cylinder wherein the tip canister insertion cylinder is configured to make an electrical positive contact with the internal surface integrated positive wire.

* * * * *